US006283873B1

(12) United States Patent
Nunes

(10) Patent No.: US 6,283,873 B1
(45) Date of Patent: Sep. 4, 2001

(54) PUTTING CUP

(76) Inventor: Brendon G. Nunes, 467 Westney Road S., Unit 3, Ajax, Ontario (CA), L19 6V7

( * ) Notice: Subject to any disclaimer, the term of this patent is extended or adjusted under 35 U.S.C. 154(b) by 0 days.

(21) Appl. No.: 09/371,963

(22) Filed: Aug. 11, 1999

Related U.S. Application Data

(60) Provisional application No. 60/097,082, filed on Aug. 19, 1998.

(51) Int. Cl.[7] ..... A63B 69/36
(52) U.S. Cl. ..... 473/180; 473/174
(58) Field of Search ..... 473/159, 174, 473/175, 189, 180, 184

(56) References Cited

U.S. PATENT DOCUMENTS

| | | | | |
|---|---|---|---|---|
| D. 353,433 | | 12/1994 | Erdoes et al. . | |
| D. 385,610 | | 10/1997 | McDonald . | |
| D. 399,285 | | 10/1998 | Ridge . | |
| D. 409,704 | | 5/1999 | Nunes . | |
| 3,572,720 | * | 3/1971 | Berg | 473/159 |
| 4,647,047 | | 3/1987 | Little . | |
| 5,788,581 | * | 8/1998 | Mabie | 473/175 |
| 5,857,919 | * | 1/1999 | Hoyt et al. | 473/184 |

OTHER PUBLICATIONS

American Sports Inc. web page http://americansportsinc-.com/golf.html; 1999.
Exclusively Golf Shopping web page http://www.exclusive-lygolf.com/giftsgreat.html; 1999.
The Golf Collection web page http://www3.viaweb.com/nygolfcenter/elputcup.html; 1999.

* cited by examiner

*Primary Examiner*—Mark S. Graham
(74) *Attorney, Agent, or Firm*—Nixon & Vanderhye P.C.

(57) ABSTRACT

A putting cup may be used not only to practice putting, but also as a promotional item, having a transparent element closing off a depression in the body of the putting cup, and with a printed sheet visible through the transparent element. The printing on the sheet may be promotional indicia, such as promoting a company, product, etc., and the putting cup may be disassembled so as to allow replacement of the printed sheet. A ramp leads up from a surface on which the putting cup is mounted to a depression in the body, which will retain a golf ball therein.

15 Claims, 5 Drawing Sheets

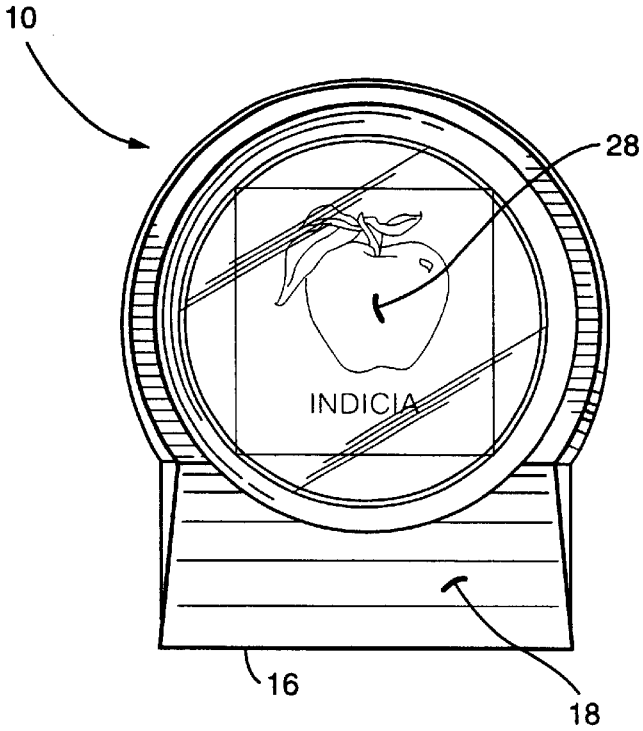
Fig. 4
Fig. 6
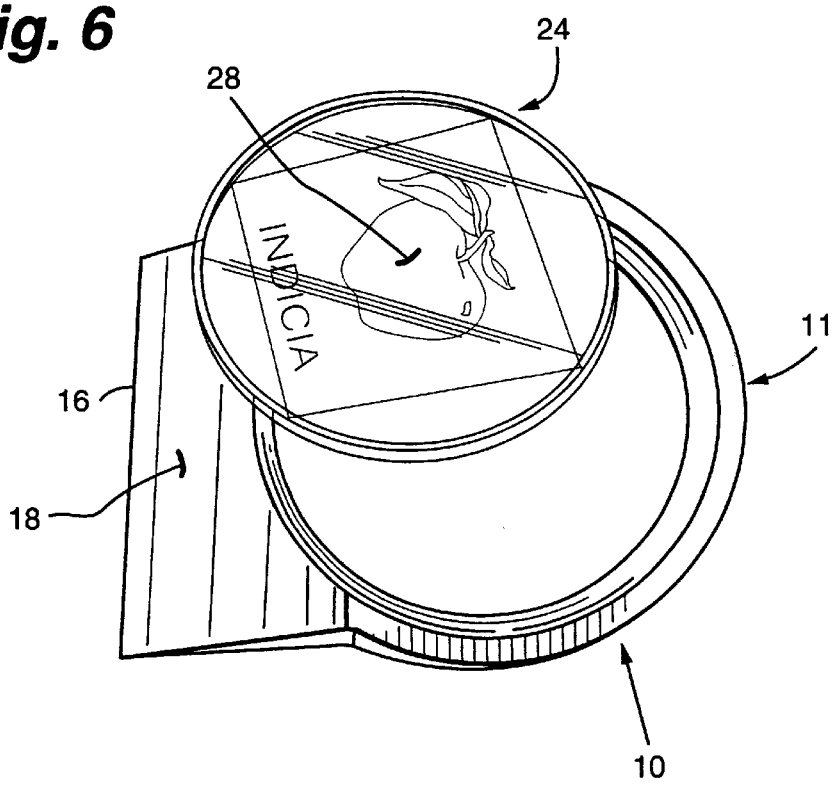

PUTTING CUP

CROSS-REFERENCE TO RELATED APPLICATION

This application is based upon provisional application 60/097,082 filed Aug. 19, 1998, the disclosure of which is hereby incorporated by reference herein.

BACKGROUND AND SUMMARY OF THE INVENTION

Golf is extremely popular in the world, with a wide variety of golf promotional items and functional objects enjoying great success. For example, many companies market personalized conventional golf tees, conventional golf balls, and the like as promotional items, and many golfers use putting cups for interludes of enjoyment at home and office.

According to the invention a golf putting cup is provided which not only has excellent functionality, but also can be used as a promotional item. The putting cup according to the invention is associated with an insert that has the ability to have promotional material thereon that is readily visible when using or displaying the putting cup. The promotional material may be changed in the cup if desired, and does not interfere with the functionality of the cup. Also, since the cup is relatively inexpensive to produce, cups with the promotional indicia associated therewith can be given away as promotional items.

According to one aspect of the present invention a putting cup is provided comprising: A body (e.g. opaque) having a substantially central depression, for receipt of a golf ball. The body defining an opening associated with the depression. A substantially transparent element closing off at least the majority of the opening beneath the depression. A ramp portion of the body leading into the depression. And, a sheet-like element having indicia thereon, and mounted with respect to the body and the substantially transparent element so that the indicia is visible through the transparent element when the transparent element is viewed through the depression.

The ramp may have a width substantially at least as great as the diameter of a golf ball, and the depression has cross-sectional dimensions larger than the largest cross-sectional area of a golf ball (e.g. two-ten times larger, for example the depression having the size of a conventional hole on a golf course). The sheet-like element may be mounted by sandwiching it between the substantially transparent element and a base element.

In one embodiment the base element has a first upstanding ridge cooperating with the base facilitating location of the base with respect to the body, a first substantially flat face from which the first ridge upstands, and a second face opposite the first face. Also the substantially transparent element has a first face, from which a second upstanding ridge upstands, and a second substantially flat face, the sheet-like element sandwiched between the first face of the base and the second face of the substantially transparent element. Typically the second ridge cooperates with the body adjacent the depression so as to facilitate locating the substantially transparent element with respect to the body.

For example the substantially transparent element comprises first and second faces, the second face substantially flat, and the sheet-like element is sandwiched between the second face of the substantially transparent element and the first face of the base. In one embodiment the base comprises a plurality of flexible material feet extending from the first face to the second face, recessed in the first face so as not to interfere with the sheet-like element, and extending outwardly from the second face (such as shown in co-pending application serial no. 09/084,248 filed May 26, 1998).

The base, body, and substantially transparent element may all be made of plastic (such as injection molded plastic), although other materials are also suitable. The sheetlike element is preferably printed cellulose, such as paper, paperboard, or cardboard. For example the indicia may comprise promotional indicia for a company, organization, product, or service.

In one embodiment the substantially transparent element makes, itself, an interference fit or a friction fit with the body. In another embodiment the base element makes an interference fit or friction fit with the body. Alternatively screws or other fasteners may be used to hold the components together, or if there is no need for replacement of the sheet-like element, they may be ultrasonically welded or otherwise are permanently affixed together.

In one embodiment the body comprises a substantially semi-circular portion having opposite ends spaced more than 180° apart, and engaging the ramp at the opposite ends thereof, and the opening is substantially circular; and typically the substantially transparent element closes off substantially the entire opening.

According to another aspect of the present invention a putting cup is provided comprising: A body having a substantially central depression for receipt of a golf ball, defining an opening at a bottom portion of the depression; and having a ramp portion leading into the depression at a top portion thereof, the ramp disposed at an angle of between about 10–30°. A substantially transparent element substantially closing off the opening. A base element mounted to the body and sandwiching the substantially transparent element between the base element and the base. And, wherein the ramp has a width substantially at least as great as the diameter of a golf ball; and wherein the depression has cross-sectional dimensions larger than the largest cross-sectional area of a golf ball. The details of the components of the putting cup may be as described above.

According to another aspect of the present invention a method of utilization of a putting cup (having a body with a ramp and a depression terminating in an opening, a transparent element, a printable sheet, and a base element) is provided. The method comprises: (a) Printing the printable sheet with indicia to form a printed sheet. (b) Sandwiching the printed sheet between the base element and substantially transparent element. (c) Mounting the base, sheet, and substantially transparent element to the body to substantially close off the opening and so that the indicia is visible through the substantially transparent element. (d) Placing the body on a surface so that the ramp leads from the surface up to the depression. And, (e) striking a golf ball with a golf club (e.g. putter) so that the ball rolls up the ramp into the depression and is maintained therein until another force is applied moving it out of the depression.

In the method (c) may be practiced using a friction or an interference fit between the base and the body. The method may further comprise (f) detaching the base from the body, (g) replacing the printed sheet with another printed sheet, and again practicing (c).

It is the primary object of the present invention to provide a versatile, multi-function, putting cup. This and other objects of the invention will become clear from an inspection of the detailed description of the invention and from the appended claims.

BRIEF DESCRIPTION OF THE DRAWINGS

FIG. 4 is a top plan view of the assembled putting cup with insert of FIG. 3;

FIG. 6 is a top plan view showing the insert with promotional indicia removed from the putting cup;

DETAILED DESCRIPTION OF THE DRAWINGS

Figure 5:
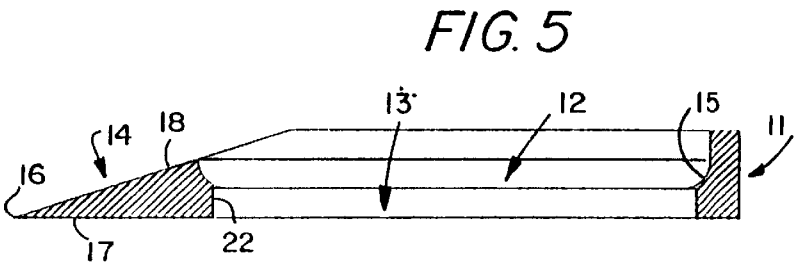
FIG. 5 is an exploded side view of FIG. 3 (except without the set screw connection but rather for the preferred friction fit embodiment)
Figure 1:
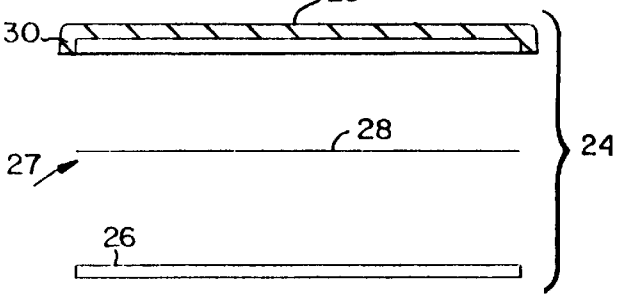
FIG. 1 shows a top plan view of one embodiment of a putting cup according to the invention without the promotional material insert therein.
Figure 1:
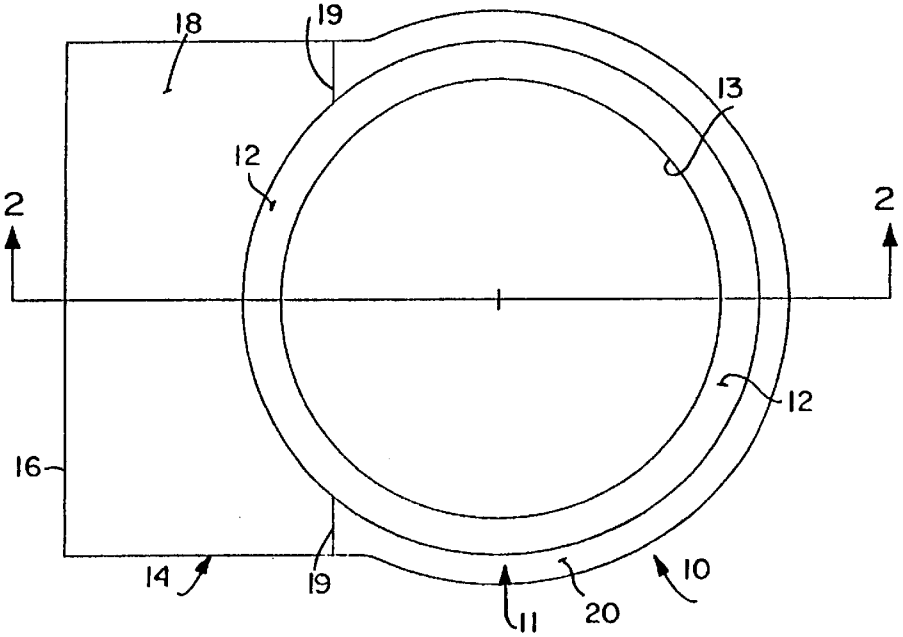
Figure 2:
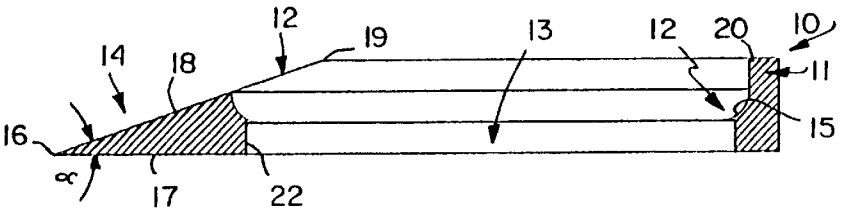
FIG. 2 is a cross-sectional view taken along lines 2—2 of FIG. 1.

The putting cup per se according to the present invention is shown generally by reference numeral 10 in the drawings. Preferably it comprises an integrally molded (e.g. injection molded) piece of preferably rigid plastic, but alternatively may be made of aluminum, brass, or other materials. The cup 10 per se includes a body 11 (preferably opaque) having a central depression 12 which preferably transitions into an opening 13, and a ramp 14 leading up to the depression 12/opening 13. In the preferred embodiment illustrated, the body 11 is semicircular, preferably having an arcuate extent of greater than 180°, e.g. about 230–270° (approximately 250° being illustrated in the drawings). The depression 12 may be substantially circular, as illustrated in the drawings, including=extending into the ramp portion 14 of the cup 10. The depression 12 preferably has a rounded configuration, as illustrated most clearly at 15 in FIGS. 2, 3, and 5. The opening 13 also is preferably substantially circular and extends completely through the body 11.

The ramp 14 preferably has a substantially straight leading edge 16 and a substantially flat bottom 17 (see FIGS. 2, 3, and 5) with the angled/slanted top surface 18, forming a generally wedge-like configuration. The angle $\alpha$ between the surfaces 17, 18 is preferably between about 10–30°, e.g. between about 15–22°, preferably about 18°. A distinct transition 19 is provided between the ramp 14 and the body 11, the spaced portions of the transition 19 being the ends of the semi-circular portion of the body 10. Preferably the top surface 20 of the body 11 is substantially flat.

Figure 3:
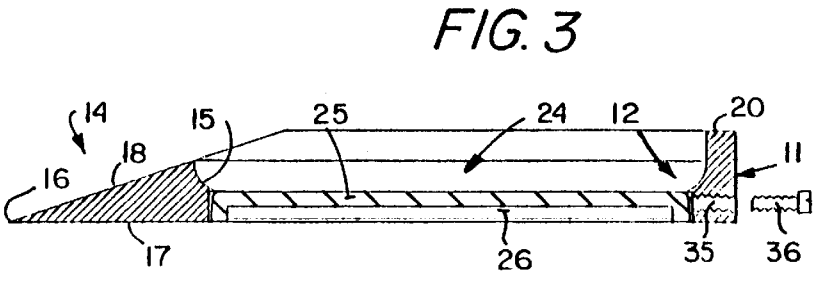
FIG. 3 is a view like that of FIG. 2 only showing the promotional indicia insert inserted in the putting cup, and also showing an alternative embodiment in which the insert may be held in place by one or more set screws.
Figure 7:
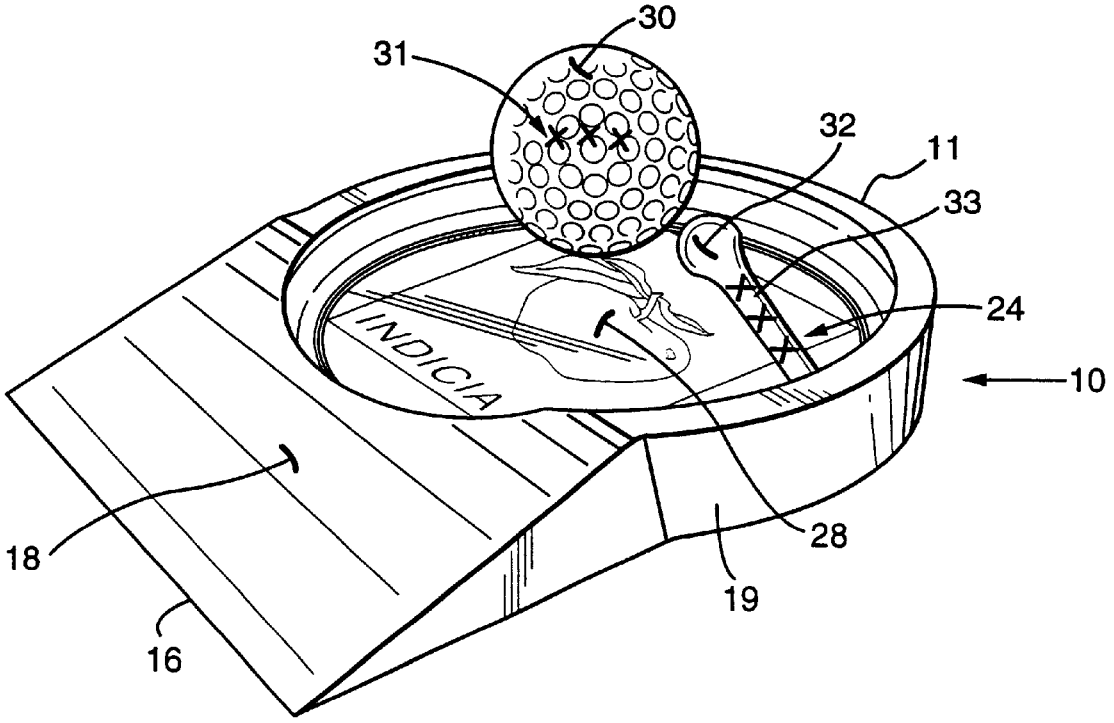
FIG. 7 is a top perspective view of the putting cup and insert of FIGS. 3 through 5 showing a golf ball and golf tee in the putting cup.

The substantially central, substantially circular—in the embodiment illustrated—opening 13 in the cup 10 has an inner peripheral surface 22 which cooperates with an insert 24. The insert 24 preferably includes the same basic components as are described in copending application Ser. No. 09/084,248 filed May 26, 1998 (thedisclosure of which is hereby incorporated by reference herein) including a transparent or translucent cover 25 (preferably of clear plastic, as described in the copending application), which is a substantially transparent element, a base 26 which has an interference fit or friction fit with the transparent member 25, and an imaged insert 27 (e.g. of cellulose material such as paper) having promotional indicia 28, or like indicia, on the surface thereof which is visible through the transparent element 25. In a preferred embodiment the peripheral surface 30 of the element 25 makes an interference or friction fit with the surface 22, being held in place as illustrated in FIGS. 3, 4, and 7. The insert 24 may have rubber feet, provided as in the prior art, or as in copending application Ser. No. 09/084,248 filed May 26, 1998. The insert 22 is a sheet-like element, preferably a sheet of paper, paperboard, cardboard, or an otherwise imaginable cellulose (or plastic) sheet.

Alternatively the insert 24 may comprise a single element, such as a wood, stone, lucite, or like disc with indicia (e.g. engraved or carved or etched therein).

The cup 10 is dimensioned so as to be effectively utilized as a putting cup with a conventional golf ball 30. For example the width of the ramp 14 is typically at least as great as the diameter of a golf ball 30, e.g. about twice as great, and the depression 12 has cross-sectional dimensions greater than those of the largest cross-section of the golf ball 30, typically at least twice as large (for example between two and ten times as large). Typically the depression 12 has approximately the same dimensions as a hole on a conventional golf course.

FIG. 7 illustrates a conventional golf ball 30 in the cup 10, to give an idea of general relative dimensions of cup 10. The golf ball 30 has personalized indicia 31 thereon which can correspond to the indicia 28 (that is the cup 10 and the golf ball 30 can be provided together as a promotion). Conventional golf tees 32—optionally with indicia 33 thereon corresponding to the indicia 28, 31—may also be provided in a common promotion.

While an interference fit or a friction fit are illustrated as the primary ways for holding the insert 24 in the putting cup 10, it is to be understood that other holding mechanisms may be utilized, such as one or more (e.g. three) radial openings 35 for receipt of set screws 36 (see FIG. 3) which engage the peripheral surface 30 of the element 25 to hold it into place. Also, the insert 24 itself may have a screw threaded exterior surface (corresponding to the surface 30 and element 25) and the surface 22 can be internally screw threaded to receive the insert 24 in a screw threaded manner.

Figure 8:
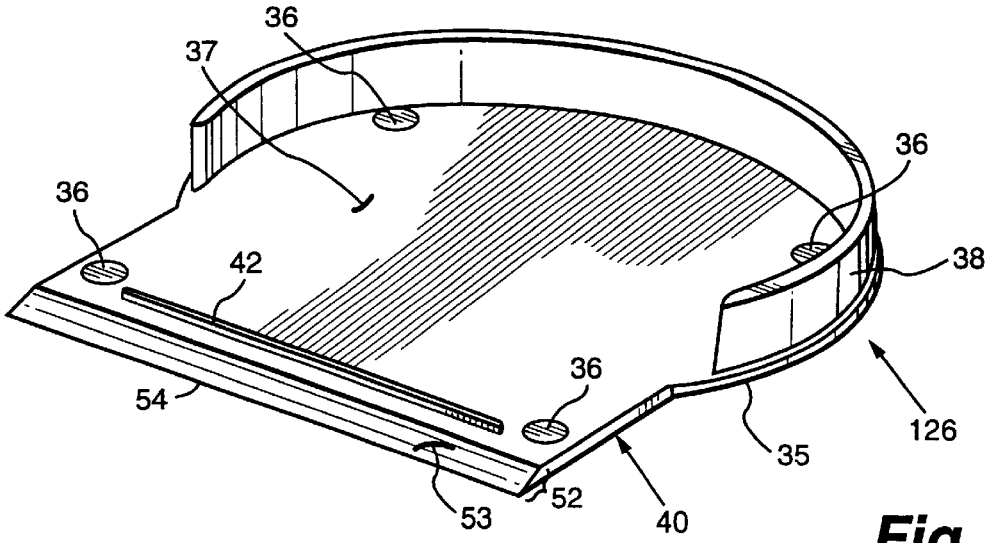
FIG. 8 is a top perspective view of a base element for a second embodiment of a putting cup according to the present invention.
Figure 9:
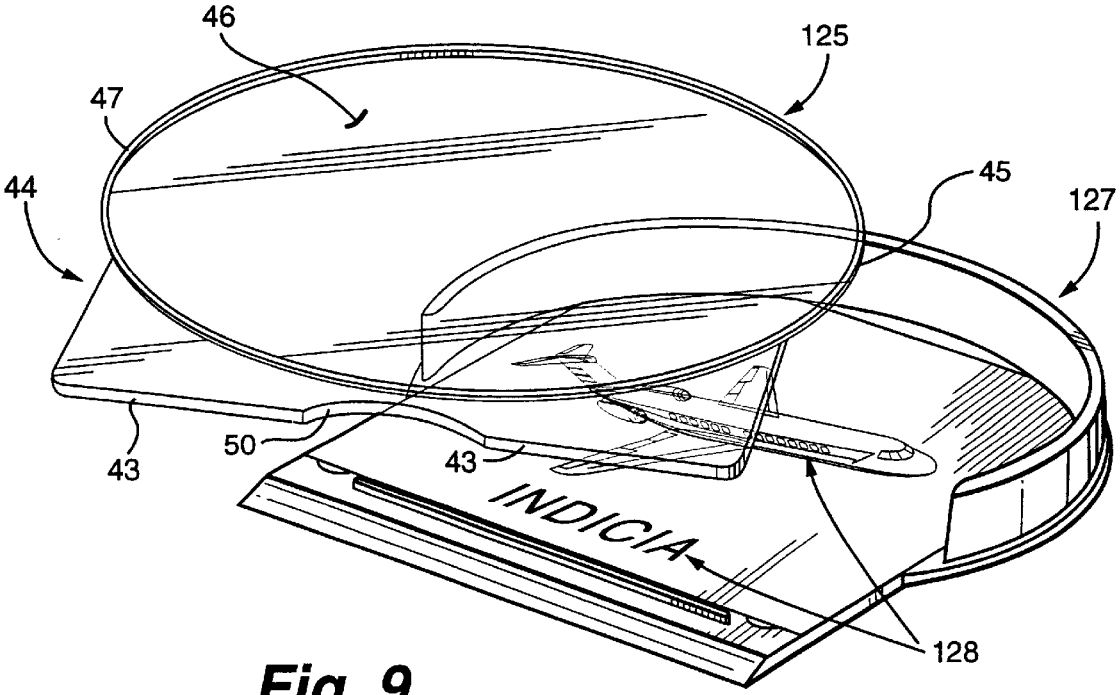
FIG. 9 is a top perspective view of both the substantially transparent element and the printed sheet for the embodiment of the putting cup of FIG. 8.
Figure 10:
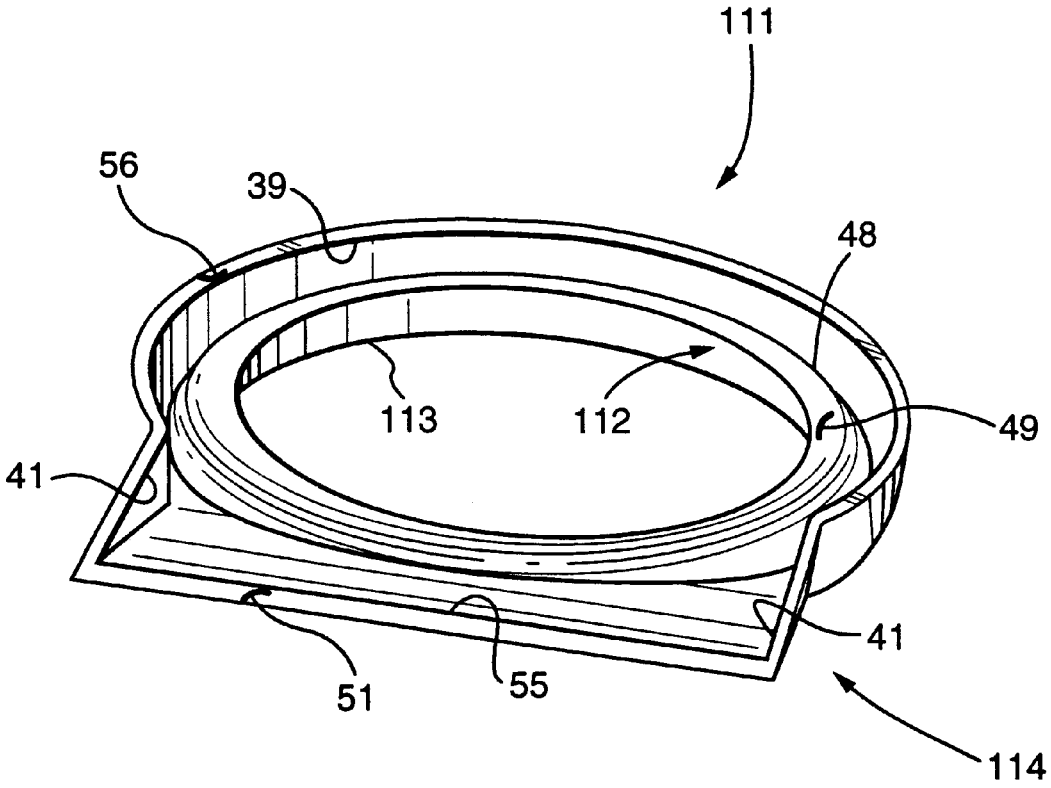
FIG. 10 is a bottom perspective view of the body of the putting cup embodiment of FIGS. 8 and 9, this embodiment being substantially identical to that of FIG. 4 when viewed in top plan.

FIGS. 8 through 10 illustrate another embodiment of a putting cup according to the present invention. This embodiment has substantially the same configuration as that of FIG. 4 when viewed from the top and assembled. In the FIGS. 8 through 10 embodiment components comparable to those in the FIGS. 1 through 7 embodiment are shown by the same reference numeral only preceded by a "1".

In the embodiment of FIGS. 8 through 10 the base element 126 is much more substantial than the base element 26, and itself actually makes a friction or interference fit (or is otherwise mounted substantially directly to) the body 111. Also in this embodiment the body 111 is substantially hollow rather than being largely solid, and it is actually the bottom face 35 of the base 126 which engages a surface with which the putting cup will be used.

The bottom face 35 of the base element 126 is substantially flat, but portions of the "rubber" or other flexible material feet 36 may extend outwardly therefrom to actually engage a surface on which the putting cup is mounted. The feet 36 are recessed on the top substantially flat face 37 of the base element 126 so as not to interfere with the printed sheet 127.

In order to fully cooperate and locate with the other elements of the putting cup, the base element 126 includes a first upstanding ridge 38, upstanding from the surface 37, and cooperating with the inner peripheral surface 39 (see FIG. 10) of the body 111 to facilitate locating the elements 126, 111 together. The ramp extension 40 of the base element 126 engages the sides 41 of the inner hollow portion of the ramp 114 of the body 111. The ramp portion 40 of the base element 126 also has an upstanding ridge 42 which cooperates with the end surface 43 of the extension 44 of the transparent element 125.

The transparent element 125 has a bottom surface 45 which is substantially flat, and a top surface 46 which also is substantially flat except that it has a second ridge 47 upstanding therefrom. The second ridge 47 preferably engages the exterior surface 48 of the ridge element 49 of the depression 112 which defines the opening 113 (see FIG. 10). The outer surface of the second ridge 47 also engages the inner surface of the first ridge 38, so that positive location between all of the components is provided. A cut-out 50 may be provided in the extension 44 of the substantially transparent element 125 in order to facilitate grasping thereof when the edges 43 engage the ridge 42.

The sheet-like element 127, with the indicia 128 thereon (typically including promotional indicia for a company, organization, product, or service), is sandwiched between the flat faces 37, 45, so that the indicia 128 is visible when looking down on the putting cup (just as in FIG. 4).

The end termination 51 of the ramp 114 is flat on the bottom (seen in FIG. 10), while the end termination 52 of the ramp portion 40 of the base element 126 is slanted, the surface 53 having the same slope as that of the ramp 114 (e.g. about 18°) so that the 30 components fit snuggly together when the outer edge 54 of the portion 52 engages the inner edge 55 of the portion 51.

When the components 111, 125, 126, and 127 are assembled together, preferably the element 126 makes an interference or friction fit with the element 111, although it can be welded into place or otherwise permanently attached if desired, or a screw such as illustrated in the FIG. 3 embodiment may be utilized. When the putting cup of the FIGS. 8 through 10 embodiment is assembled the portions thereof that touch the surface on which it is mounted (if the feet 36 are not provided) are the portion 51, substantially the entire bottom surface 35 of the base element 26, and the bottom surface 56 of the outer rim of the body 111 (see FIG. 10).

While it is preferred to use three elements in addition to the sheet 27, 127, if desired the elements 25, 26 or 125, 126 can be made integral, and a slot provided therein to slide the sheet 27, 127 thereinto.

In an exemplary method according to the present invention (with reference to both embodiments), the printable sheet 27, 127 is printed with the indicia 28, 128 to form a printed sheet, and is sandwiched between the base element 26, 126, and the substantially transparent element 25, 125. Printing typically may be done very simply and inexpensively by using a laser or ink jet printer or any other conventional type of office printer for printing documents. The sheet that is printed may be cut to size using any suitable conventional manual or automatic device so that the printed sheet (27, 127) fits appropriately in the putting cup. The base 26, 126, sheet 27, 127, and substantially transparent element 25, 125 are mounted to the body 11, 111 to substantially close off the opening 13, 113 and so that the indicia 28, 128 is visible through the substantially transparent element 25, 125. Then the body 111 is placed on a surface so that the ramp 14, 114 leads from the surface (such as the floor of a room) up to the depression 12, 112. Then one strikes a golf ball with a golf club (typically a putter), like the golf ball 30, so that the golf ball 30 rolls up the ramp 14, 114 into the depression 12, 112 and is maintained therein until another force is applied moving it out of the depression 12, 112 (e.g. by lifting the golf ball 30 out, topping it with the club so that it pops out, inverting the cup 10, etc.).

The method may be further practiced by providing a friction or an interference fit between the base 126 and the body 111 (e.g. the surfaces 38, 39, 53, 55, and 40, 41 thereof). Also the method may further comprise detaching the base 26, 126 from the body 11, 111, replacing the printed sheet 27, 127 with another printed sheet having different indicia, and again assembling the components together.

A wide variety of other modifications are also possible, including the shapes of the opening (e.g. polygonal) 13, 113 and the body 11, 111, and a wide variety of other aspects. The invention is to be accorded the broadest scope possible considering the prior art, and to encompass all equivalent products and methods.

What is claimed is:

1. A putting cup comprising:

a portable body having a substantially central depression, for receipt of a golf ball;

said body defining an opening associated with said depression;

a substantially transparent element substantially completely closing off said opening beneath said depression;

a ramp portion of said body leading into said depression;

a sheet-like element having indicia thereon, and mounted with respect to said body and said substantially transparent element so that said indicia is visible through said transparent element when said transparent element is viewed through said depression; and a base element having a first upstanding ridge facilitating location of said base element with respect to said body, a first substantially flat face from which said first ridge upstands, and a second substantially flat face opposite said first face, wherein said sheet-like element is mounted by sandwiching said sheet-like element between said substantially transparent element and said base element, wherein said body is hollow and has an open bottom, and wherein said base element has a portion thereof completely closing off the open bottom of said ramp portion of said body.

2. A putting cup as recited in claim 1 wherein said ramp portion has a width substantially at least as great as the diameter of a golf ball; and wherein said depression has cross-sectional dimensions larger than the largest cross-sectional area of a golf ball.

3. A putting cup as recited in claim 1 wherein said substantially transparent element has a first face, from which a second upstanding ridge upstands, and a second substantially flat face, said sheet-like element sandwiched between said first face of said base element and said second face of said substantially transparent element.

4. A putting cup as recited in claim 3 wherein said second ridge cooperates with said body adjacent said depression so as to facilitate locating said substantially transparent element with respect to said body.

5. A putting cup as recited in claim 1 wherein said substantially transparent element comprises first and second faces, said second face substantially flat; said sheet-like element sandwiched between said second face of said substantially transparent element and said first face of said base element.

6. A putting cup as recited in claim 5 wherein said base element comprises a plurality of flexible material feet extending from said first face of said base element to said second face of said base element, recessed in said first face of said base element so as not to interfere with said sheet-like element, and extending outwardly from said second face of said base element.

7. A putting cup as recited in claim 5 wherein base, body, and substantially transparent element are plastic, and said sheet-like element is printed cellulose.

8. A putting cup as recited in claim 1 wherein said substantially transparent element has an interference fit or friction fit with said body.

9. A putting cup as recited in claim 1 wherein said base element has an interference fit or friction fit with said body.

10. A putting cup as recited in claim 1 wherein said sheet-like element is completely detachable from said base and said substantially transparent element so as to be readily replaceable; and wherein said sheet-like element is paper, or paperboard, having said indicia printed thereon.

11. A putting cup as recited in claim 1 wherein said sheet-like element is paper, or paperboard, having said indicia printed thereon; and wherein said printed indicia includes promotional indicia for a company, organization, product, or service.

12. A putting cup as recited in claim 1 wherein said body comprises a substantially semi-circular portion having opposite ends spaced more than 180° apart, and engaging said ramp portion at said opposite ends thereof, and said opening is substantially circular.

13. A putting cup as recited in claim 12 further comprising a base element; and wherein said ramp portion has a width substantially at least as great as the diameter of a golf ball and is at an angle of between about 10–30°; and wherein said depression has cross-sectional dimensions approximately the same as a golf course hole; wherein said base element has an interference fit or friction fit with said body; wherein said sheet-like element is completely detachable from said base element and said substantially transparent element so as to be readily replaceable; wherein said sheet-like element is paper or paperboard having said indicia printed thereon; and wherein said printed indicia includes promotional indicia for a company, organization, product, or service.

14. A putting cup comprising:

a body having a substantially central depression for receipt of a golf ball, defining an opening at a bottom portion of said depression; and having a ramp portion leading into said depression at a top portion thereof, said ramp disposed at an angle of between about 10–30°; and a substantially transparent element substantially closing off said opening;

a base element mounted to said body and sandwiching said substantially transparent element between said base element and said body, wherein said ramp has a width substantially at least as great as the diameter of a golf ball; wherein said depression has cross-sectional dimensions larger than the largest cross-sectional area of a golf ball; and wherein said body is hollow and has an open bottom, and wherein said base element has a portion thereof completely closing off the open bottom of said ramp portion of said body.

15. A putting cup as recited in claim 14 wherein said body comprises a substantially semi-circular portion having opposite ends spaced more than 180° apart, and engaging said ramp at said opposite ends thereof, and said opening is substantially circular; and further comprising a paper or paperboard sheet having printed indicia thereon promoting a company, product, service, or organization; said sheet sandwiched between said base element and said body so that said indicia is visible through said substantially transparent element from said top portion of said base element.

* * * * *